US006265124B1

(12) United States Patent
Luo et al.

(10) Patent No.: US 6,265,124 B1
(45) Date of Patent: Jul. 24, 2001

(54) PHOTOCONDUCTORS AND CHARGE GENERATION LAYERS COMPRISING POLYMERIC HINDERED PHENOLS

(75) Inventors: Weimei Luo, Louisville; Mark Thomas Bellino, Longmont, both of CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/584,358

(22) Filed: May 31, 2000

(51) Int. Cl.[7] ..... G03G 5/047
(52) U.S. Cl. ..... 430/58.4; 430/96
(58) Field of Search ..... 430/96, 58.4

(56) References Cited

U.S. PATENT DOCUMENTS

| | | | | |
|---|---|---|---|---|
| 3,944,523 | | 3/1976 | Gobran . | |
| 4,032,486 | | 6/1977 | Gobran . | |
| 4,218,528 | | 8/1980 | Shimada et al. . | |
| 4,446,264 | | 5/1984 | Cottman . | |
| 4,563,408 | | 1/1986 | Lin et al. . | |
| 4,764,571 | | 8/1988 | Namba et al. . | |
| 4,931,372 | | 6/1990 | Takei et al. . | |
| 4,976,783 | | 12/1990 | Werner . | |
| 5,089,587 | | 2/1992 | Namba et al. . | |
| 5,320,923 | | 6/1994 | Nguyen . | |
| 5,380,613 | | 1/1995 | Ueda et al. . | |
| 5,578,405 | | 11/1996 | Ikegami et al. . | |
| 5,707,766 | | 1/1998 | Nogami et al. . | |
| 5,750,300 | | 5/1998 | Nguyen . | |
| 5,780,545 | * | 7/1998 | Chen et al. | 524/860 |
| 5,804,345 | | 9/1998 | Itami et al. . | |
| 5,942,362 | | 8/1999 | Tadokoro et al. . | |
| 5,948,579 | | 9/1999 | Mashimo et al. . | |
| 5,972,549 | | 10/1999 | Levin et al. . | |
| 5,972,552 | | 10/1999 | Ganapathiappan et al. . | |
| 6,165,662 | * | 12/2000 | Kato et al. | 430/96 |

* cited by examiner

*Primary Examiner*—John Goodrow
(74) *Attorney, Agent, or Firm*—John A. Brady

(57) ABSTRACT

A photoconductor comprises a substrate and a charge generation layer comprising a charge generation molecule and a binder selected from the group consisting of butylated reaction products of p-cresol and dicyclopentadine. The photoconductor demonstrates improved electrical characteristics in fatigue properties.

37 Claims, 3 Drawing Sheets

INITIAL VOLTAGE V. ENERGY CURVES OF SAMPLE 3 AND COMPARATIVE EXAMPLE 2

PHOTOCONDUCTORS AND CHARGE GENERATION LAYERS COMPRISING POLYMERIC HINDERED PHENOLS

FIELD OF THE INVENTION

The present invention is directed toward photoconductors and compositions used to form photoconductors. More particularly, the invention is related to charge generation compositions and charge generation layers comprising a polymeric hindered phenol selected from the group consisting of butylated reaction products of p-cresol and dicyclopentadiene. The invention is also directed towards methods of improving electrical characteristics and fatigue properties of photoconductors.

BACKGROUND OF THE INVENTION

In electrophotography, a latent image is created on the surface of an imaging member such as a photoconducting material by first uniformly charging the surface and then selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner.

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to use of a charge transport layer which comprises a hole transport material as the charge transport compound. One skilled in the art will appreciate that if the charge transport layer contains an electron transport material rather than a hole transport material, the charge placed on a photoconductor surface will be opposite that described herein.

When the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface Conventionally, the charge generation layer comprises the charge generation compound or molecule, for example a squaraine pigment, a phthalocyanine, or an azo compound, alone or in combination with a binder. The charge transport layer typically comprises a polymeric binder containing the charge transport compound or molecule. The charge generation compounds within the charge generation layer are sensitive to image-forming radiation and photogenerate electron-hole pairs therein as a result of absorbing such radiation. The charge transport layer is usually non-absorbent of the image-forming radiation and the charge transport compounds serve to transport holes to the surface of a negatively charged photoconductor. Photoconductors of this type are disclosed in the Adley et al U.S. Pat. No. 5,130,215 and the Balthis et al U.S. Pat. No. 5,545,499.

Cottman, U.S. Pat. No. 4,446,264, discloses compounds which are prepared by reacting maleic anhydride, maleic acid or their esters with thiols, and which exhibit a synergistic effect when combined with a phenolic antioxidant for the stabilization of polymers, rubbers and lubricants. Cottman discloses suitable phenolic antioxidants include the butylated reaction product of p-cresol and dicyclopentadiene.

Nguyen, U.S. Pat. No. 5,320,923, discloses an organic positive-charging photoconductor for laser printers having a conductive substrate, a hydroxy-containing binder, a phthlaocyanine pigment and a reactive stabilizer containing silicon. Nguyen teaches the binder may comprise phenolic resins or phenoxy resins.

Levin, et al., U.S. Pat. No. 5,972,549, disclose photoconductors comprising a substrate, and a charge transport layer comprising binder and a charge transport compound comprising at least one of the hydrazone, aromatic amine, or substitute aromatic amine, and a charge generation layer comprising binder, phthalocyanine charge generating compound, and a hindered hydroxylated aromatic compound. Levin, et al. teach that the hindered hydroxylated aromatic compound reduces electrical fatigue on cycling without adversely affecting the electrical performance of the photoconductor.

Inorganic photoconductive materials such as selenium, zinc oxide, and cadmium sulfide tend to show low loss of charge in the dark, however, photoconductors comprising such materials are often difficult and/or expensive to produce. Additionally, environmental disposal issues often arise when inorganic compounds are utilized. Organic photoconductive materials are generally less expensive and are less likely to cause environmental concerns. However, photoconductors comprising organic charge generation molecules may exhibit blurring of images caused by deterioration due to ozone and/or nitrogen oxides generated by corona discharge. Thus, it is desirable for photoconductors to comprise antioxidants which may mitigate damages caused from gases such as ozone or nitrogen oxides. Additionally, it is desirable to develop methods of improving the electrical properties and the fatigue characteristics of photoconductors.

SUMMARY OF THE INVENTION

Accordingly, it is an object of this invention to provide improved photoconductors and charge generation layer compositions.

It is another object of this invention to provide photoconductors having improved electrical characteristics and fatigue properties.

It is another object of this invention to provide charge generation layer compositions comprising antioxidants.

It is another object of this invention to provide binder blends which form stable dispersions.

It is yet another object of this invention to provide photoconductors which exhibit increased sensitivity without requiring an increase in the amount of charge generation molecules.

In accordance with one aspect of the invention there are provided photoconductors comprising a substrate and a charge generation layer comprising a charge generation molecule and a first binder selected from the group consisting of butylated reaction products of p-cresol and dicyclopentadiene.

In accordance with another aspect of the invention there are provided methods of improving an electrical characteristic of a photoconductor, comprising the step of forming a photoconductor comprising a substrate and a charge generation layer comprising a binder blend. The binder blend comprises a first binder selected from the group consisting of butylated reaction products of p-cresol and dicyclopentadiene and a second binder.

In accordance with yet another aspect of the invention there are provided methods of improving fatigue properties of a photoconductor comprising an organic charge generation molecule, the method comprising the step of forming a photoconductor comprising a substrate and a charge generation layer comprising an organic charge generation molecule and a polymeric hindered phenol selected from the group consisting of butylated reaction products of p-cresol and dicyclopentadiene.

In accordance with one aspect of the invention there are provided charge generation compositions comprising charge generation molecule, solvent and binder blend. The binder blend comprises a polymeric hindered phenol selected from the group consisting of butylated reaction products of p-cresol and dicyclopentadiene.

In accordance with another aspect of the invention there are provided photoconductors comprising a charge generation layer comprising a polymeric hindered phenol selected from the group consisting of butylated reaction products of p-cresol and dicyclopentadiene, wherein the photoconductor exhibits a voltage of no greater than about 200 volts 25 milliseconds after exposure to laser energy of 0.30 $\mu J/cm^2$.

Additional embodiments and advantages of the photoconductors, charge generation layers, charge generation compositions and methods herein will be apparent from the following description.

BRIEF DESCRIPTION OF THE DRAWINGS

While this specification concludes with claims particularly pointing out and distinctly claiming the present invention, it is believed that the same will be better understood from the following description taken in conjunction with the accompanying drawings in which:

DETAILED DESCRIPTION

Figure 1:
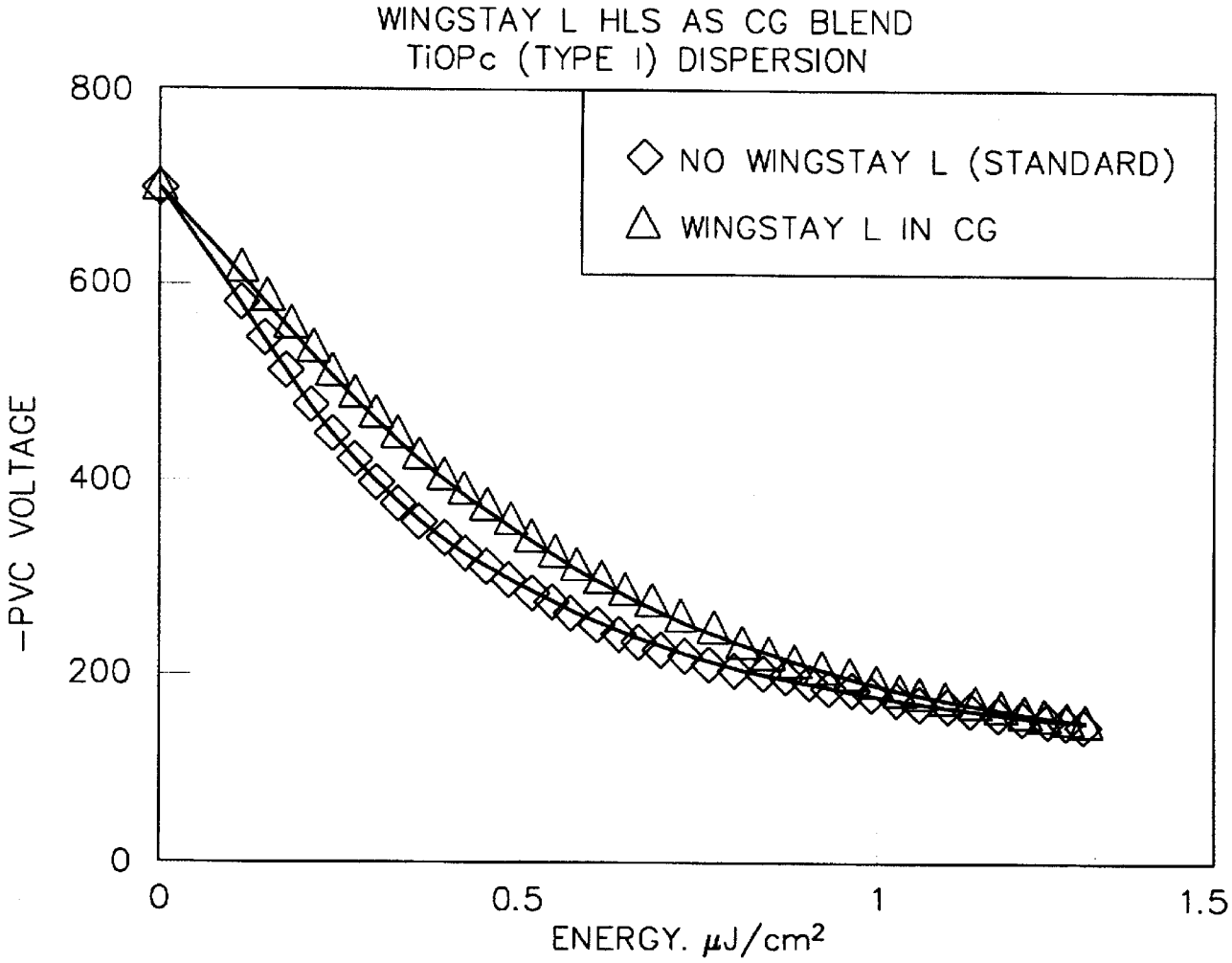
FIG. 1 is a graphical representation of initial voltage versus energy.

The charge generation layers according to the present invention are suitable for use in both single layer photoconductors and dual layer photoconductors. Charge generation layers provide charge carriers or electron hole pairs upon exposure of a photoconductor to light. Single layer photoconductors comprise a photoconductive charge generation layer comprising a charge generation molecule and binder. Preferably the photoconductors are dual layer photoconductors. Dual layer photoconductors generally comprise a substrate, a charge generation layer (CGL) comprising a charge generation molecule and a binder and a charge transport layer (CTL) comprising a charge transport molecule and a binder. The photoconductors may also comprise a sub-layer to assist in the adhesion of the charge generation and charge transport layers, or a protective coating to reinforce the durability of the charge generation and charge transport layers. Some substrates, such as aluminum, may be anodized.

While various embodiments of the invention discussed herein refer to the charge generation layer as being formed on the substrate, with the charge transport layer formed on the charge generation layer, it is equally within the scope of the present invention for the charge transport layer to be formed on the substrate with the charge generation layer formed on the charge transport layer.

The present invention is directed toward photoconductors, and more particularly to photoconductors comprising charge generation layers comprising binder blends containing a polymeric hindered phenol. Photoconductors comprising charge generation layers in accordance with the present invention exhibit improved electrical characteristics such as improved photosensitivity, reduced dark decay, and/or reduced fatigue.

Additionally, the present invention is directed toward compositions used to form CGLs, referred to as "charge generation compositions".

As used herein, "charge voltage" refers to the voltage applied on a drum by a charge roll or corona. "Discharge voltage" refers to the voltage on the drum after shining light on the drum. Discharge voltage may be measured at several different light energies. Whereas the streak voltage corresponds to the voltage measured at the lower laser light energy (about 0.2 microjoules/$cm^2$), the discharge voltage corresponds to voltage at the higher laser energy.

Photoconductor drums may exhibit a loss of charge in the dark, i.e., may lose some charge before a light source discharges the charge. As used herein, "dark decay" refers to the loss of charge from the surface of a photoconductor when it is maintained in the dark. Dark decay is an undesirable feature as it reduces the contrast potential between image and background areas, leading to washed out images and loss of gray scale. Dark decay also reduces the field that the photoconductive process will experience when light is brought back to the surface, thereby reducing the operational efficiency of the photoconductor.

As used herein, "fatigue" refers to the tendency for a photoconductor to exhibit increases (negative) or decreases (positive) in its discharge voltage. Fatigue is undesirable as it reduces the development factor resulting in light or washed out print or dark print, as well as print that varies from page to page.

Photoconductors in accordance with the invention comprise a charge generation layer. The charge generation layer comprises a polymeric hindered phenol. In one embodiment, the polymeric hindered phenol serves as a binder and is present in a binder blend comprising the polymeric hindered phenol and an additional binder other than the polymeric hindered phenol.

The polymeric hindered phenol is selected from the group consisting of alkylated, preferably butylated, reaction products of p-cresol and dicyclopentadiene. The butylated reactions product of p-cresol and dicyclopentadiene are believed to have the structure:

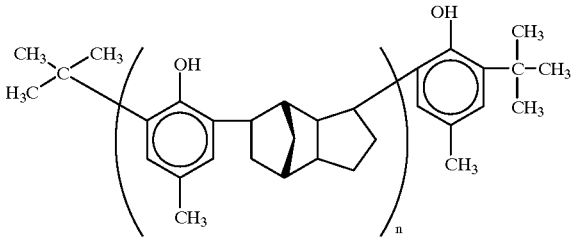

wherein n is at least 1, preferably greater than 1, more preferably from about 1 to about 7. Generally the polymeric hindered phenol has a molecular weight in the range of from several hundred to about several thousand, such as from about 460 to about 4600, preferably from about 460 to about 2200. A suitable commercially available butylated reaction product of p-cresol and dicyclopentadiene is Wingstay® L HLS, available from Goodyear Chemicals.

Generally, the binder blend comprises, by weight of total binder blend, no more than about 90%, preferably no more than about 75%, of the polymeric hindered phenol In one embodiment, the binder blend comprises from about 10% to about 90%, preferably from about 25% to about 75%, more preferably from about 50% to about 75%, of the polymeric hindered phenol. The weight ratio of polymeric hindered phenol to other binders is generally in the range of about 9:1 to about 1:9; preferably in the range of from about 3:1 to about 1:3, and even more preferably in the range of from about 1:1 to about 3:1.

In addition to the polymeric hindered phenol, the binder blend may comprise any other binder known in the art for use in charge generation layers. In one embodiment, the additional binder of the charge generation layer is inactive, that is, does not exhibit either charge generation or charge transporting properties, and may comprise vinyl polymers such as polyvinylchloride, polyvinylbutyral, polyvinylacetate, styrene polymers, and copolymers of these vinyl polymers, acrylic acid and acrylate polymers and copolymers, polycarbonate polymers and copolymers, including polyestercarbonates, polyesters, alkyd resins, polyamides, polyurethanes, epoxy resins and mixtures thereof. In one embodiment, the binder comprises a polyvinylbutyral polymer.

Polyvinylbutyral polymers are well known in the art and are commercially available from various sources. These polymers are typically made by condensing polyvinyl alcohol with butyraldehyde in the presence of an acid catalyst, for example sulfuric acid, and contain a repeating unit of formula:

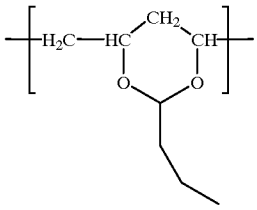

Typically, the polyvinylbutyral polymer will have a number average molecular weight of from about 20,000 to about 300,000. The weight ratio of polyvinylbutyral to polymeric hindered phenol in the charge generation layer of one embodiment is in the range of from about 90:10 to about 90:10, preferably from about 25:75 to about 75:25.

Various organic and inorganic charge generation compounds are known in the art, any of which arc suitable for use in the charge generation layers of the present invention. Inorganic charge generation compounds include selenium, selenium-tellurium alloys, selenium-arsenic alloys, cadmium sulfide, zinc oxide and titanium oxide.

Preferably the charge generation molecule is an organic compound. One type of charge generation compound which is particularly suitable for use in the charge generation layers of the present invention comprises the squarylium-based pigments, including squaraines. Squarylium pigment may be prepared by an acid route such as that described in U.S. Pat. Nos. 3,617,270, 3,824,099, 4,175,956, 4,486,520 and 4,508,803, which employs simple procedures and apparatus, has a short reaction time and is high in yield. The squarylium pigment is therefore very inexpensive and is easily available.

Preferred squarylium pigments suitable for use in the present invention may be represented by the structural formula:

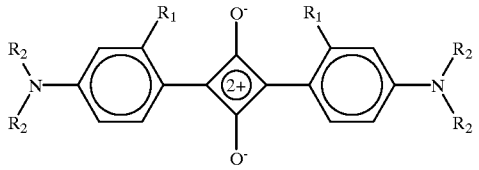

wherein $R_1$ represents hydroxy, hydrogen or $C_{1-5}$ alkyl, preferably hydroxy, hydrogen or methyl, and each $R_2$ individually represents $C_{1-5}$ alkyl or hydrogen. In a further preferred embodiment, the pigment comprises a hydroxy squaraine pigment wherein each $R_1$ in the formula set forth above comprises hydroxy.

Another type of pigment which is particularly suitable for use in the charge generation layers of the present invention comprises the phthalocyanine-based compounds. Suitable phthalocyanine compounds include both metal-free forms such as the X-form metal-free phthalocyanines and the metal-containing phthalocyanines. In a preferred embodiment, the phthalocyanine charge generation compound may comprise a metal-containing phthalocyanine wherein the metal is a transition metal or a group IIIA metal. Of these metal-containing phthalocyanine charge generation compounds, those containing a transition metal such as copper, titanium or manganese or containing aluminum or gallium as a group IIIA metal are preferred. These metal-containing phthalocyanine charge generation compounds may further include oxy, thiol or dihalo substitution. Titanium-containing phthalocyanines as disclosed in U.S. Pat. Nos. 4,664,997, 4,725,519 and 4,777,251, including oxo-titanyl phthalocyanines, and various polymorphs thereof, for example type IV polymorphs, and derivatives thereof, for example halogen-substituted derivatives such as chlorotitanyl phthalocyanines, are suitable for use in the charge generation layers of the present invention.

Additional conventional charge generation compounds known in the art, including, but not limited to, disazo compounds, for example as disclosed in the Ishikawa et al U.S. Pat. No. 4,413,045, and tris and tetrakis compounds as known in the art, are also suitable for use in the charge generation layers of the present invention. It is also within the scope of this invention to employ a mixture of charge generation pigments or compounds in the charge generation layer.

In one embodiment of the invention, the charge generation molecule is a pigment selected from the group consisting of azo pigments, anthraquinone pigments, polycyclic quinone pigments, indigo pigments, diphenylmethane pigments, azine pigments, cyanine pigments, quinoline pigments, benzoquinone pigments, napthoquinone pigments, naphthalkoxide pigments, perylene pigments, fluorenone pigments, squarylium pigments, azuleinum pigments, quinacridone pigments, phthalocyanine pigments, naphthaloxyanine pigments, porphyrin pigments and mixtures thereof. In one embodiment, the charge generation molecule is a pigment selected from the group consisting of hydroxy squaraines, Type IV oxotitanium phthalocyanines, and mixtures thereof. In a preferred embodiment the charge generation molecule is selected from the group consisting of metal-free phthalocyanine, titanyl phthalocyanine, pyrylene pigments, azo dyes and mixtures thereof.

The charge generation layers may further contain any conventional additives known in the art for use in charge generation layers.

In one embodiment, the weight ratio of charge generation molecule to total binder in the charge generation layer is from about 5:1 to about 1:2, preferably from about 3:1 to about 1:2, more preferably from about 2:1 to about 1:2. The charge generation layer generally comprises from about 10% to about 90%, preferably from about 20% to 75% total binder. In one embodiment, the charge generation layer comprises from about 40% to about 55%, by weight, total binder. A charge generation layer generally comprises from about 40% to about 80%, preferably from at least about 5%, preferably at least about 10%, more preferably at least about 15%, and up to about 60%, preferably up to about 50%, charge generation molecule. In one embodiment the charge generation layer comprises at least about 15%, preferably from about 20% to about 60%, more preferably from about 45% to about 60% and even more preferably from about 20% to about 60%, charge generation molecule.

Charge generation compositions used to form charge generation layers are generally in the form of a dispersion and comprise a solvent. Solvents which may be used to form charge generation compositions include conventional organic solvents such as methanol, ethanol, n-propanol, n-butanol, benzylalcohol, methylcellosolve, ethylcellosolve, acetone, methyl ethyl ketone, cyclohexanone, methyl acetate, ethyl acetate, n-butyl acetate, dioxane, tetrahydrofuran, methylene chloride, chloroform, benzene, toluene, xylene, chlorobenzene, 1,2-dichloroethane, dichloromethane, N,N-dimethylformaldehyde and mixtures thereof. Preferred solvents include cyclohexanone and methyl ethyl ketone.

In a preferred embodiment the photoconductor comprises a charge transport layer and a charge generation layer. The charge transport layer generally comprises the charge transport compound in an amount of from about 5% to about 60%, preferably from about 20% to about 50%, by weight of the charge transport layer, with the remainder of the charge transport layer comprising the binder, and any conventional additives.

Conventional charge transport compounds suitable for use in the charge transport layer of dual photoconductors in accordance with the present invention should be capable of supporting the injection of photo-generated holes or electrons from the charge generation layer and allowing the transport of these holes or electrons through the charge transport layer to selectively discharge the surface charge. Suitable charge transport compounds for use in the charge transport layer include, but are not limited to, the following:

1. Diamine transport molecules of the types described in U.S. Pat. Nos. 4,306,008, 4,304,829, 4,233,384, 4,115, 116, 4,299,897, 4,265,990 and/or 4,081,274. Typical diamine transport molecules include benzidine compounds, including substituted benzidine compounds such as the N,N'-diphenyl-N,N'-bis (alkylphenyl)-[1,1'-biphenyl]-4,4'-diamines wherein the alkyl is, for example, methyl, ethyl, propyl, n-butyl, or the like, or halogen substituted derivatives thereof, and the like.
2. Pyrazoline transport molecules as disclosed in U.S. Pat. Nos. 4,315,982, 4,278,746 and 3,837,851. Typical pyrazoline transport molecules include 1 -[lepidyl-(2)]-3 -(p-diethylaminophenyl)-5-(p-diethylaminophenyl)pyrazoline, 1-[quinolyl-(2)]-3-(p-diethylaminophenyl)-5-(p-diethylaminophenyl) pyrazoline, 1-[pyridyl-(2)]-3-(p-diethylaminostyryl)-5-(p-diethylaminophenyl)pyrazoline,1 -[6-methoxypyridyl-(2)]-3-(p-diethylaminostyryl)-5-(p-diethylaminophenyl) pyrazoline, 1-phenyl-3-[p-diethylaminostyryl]-5-(p-dimethylaminostyryl) pyrazoline, 1-phenyl-3-[p-diethylaminostyryl]-5-(p-diethylaminostyryl)pyrazoline, and the like.
3. Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2,4'-dimethoxybenzylidene)fluorene, 2-nitro-9-benzylidene-fluorene, 2-nitro-9-(4'-diethylaminobenzylidene)fluorene and the like.
4. Oxadiazole transport molecules such as 2,5-bis(4-diethylaminophenyl)-1,3,4-oxadiazole, imidazole, triazole, and others as described in German Patents Nos. 1,058,836, 1,060,260 and 1,120,875 and U.S. Pat. No. 3,895,944.
5. Hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde (diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pat. Nos. 4,385,106, 4,338,388, 4,387,147, 4,399,208 and 4,399,207. Yet other hydrazone charge transport molecules include carbazole phenyl hydrazones such as 9-methylcarbazole-3-carbaldehyde-1,1 -diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426.

In one embodiment, the charge transport compound included in the charge transport layer comprises a hydrazone, an aromatic amine (including aromatic diamines such as benzidine), a substituted aromatic amine (including substituted aromatic diamines such as substituted benzidines), or a mixture thereof. Preferred hydrazone transport molecules include derivatives of aminobenzaldehydes, cinnamic esters or hydroxylated benzaldehydes. Exemplary aminobenzaldehyde-derived hydrazones include those set forth in the Anderson et al U.S. Pat. Nos. 4,150,987 and 4,362,798, while exemplary cinnamic ester-derived hydrazones and hydroxylated benzaldehyde-derived hydrazones are set forth in the copending Levin et al U.S. applications Ser. Nos. 08/988,600 and 08/988,791, respectively, all of which patents and applications are incorporated herein by reference. Preferred charge transport compound are triarylamines, benzidines and hydrazones.

In one embodiment the charge transport compound comprises a compound selected from the group consisting of poly(N-vinylcarbazole)s, poly(vinylanthracene)s, poly(9, 10-anthracenenylene-dodecanedicarboxylate)s, polysilanes, polygermanes, poly(p-phenylene-sulfide), hydrazone compounds, pyrazoline compounds, enamine compounds, styryl compounds, arylmethane compounds, arylamine compounds, butadiene compounds, azine compounds, and mixtures thereof. In a preferred embodiment the charge transport compound comprises a compound selected from the group consisting of p-diethylaminobenzaldehyde-(diphenylhydrazone) (DEH), N,N'-bis-(3-methylphenyl)-N, N'-bis-phenyl-benzidine (TPD) and mixtures thereof. TPD has the formula:

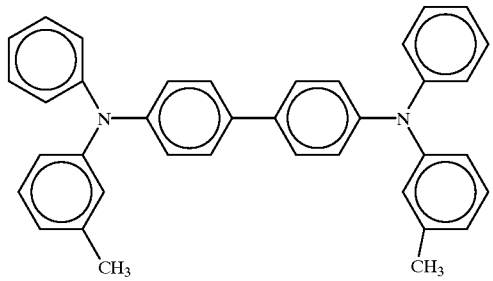

The charge transport layer may comprise a binder, such as a polycarbonate. Suitable polycarbonates include polycarbonate-A's, polycarbonate-Z's, and mixtures thereof. Preferred polycarbonates have a number average molecular weight of from about 10,000 to about 100,000, preferably from about 20,000 to about 80,000. A preferred polycarbonate includes a polycarbonate-A having the structure set forth below:

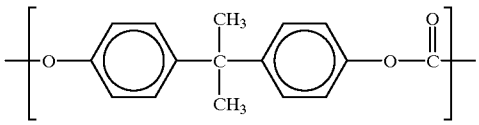

Such a polycarbonate-A is available from Bayer Corporation as MAKROLON®-5208 Polycarbonate, having a number average molecular weight of about 34,000.

The charge transport layer generally comprises from about 5% to about 60%, preferably from about 20% to about 50%, by weight, charge transport molecule and from about 40% to about 95%, preferably from about 50% to about 80%, by weight, binder.

The photoconductor substrate may be flexible, for example in the form of a flexible web or a belt, or inflexible, for example in the form of a drum. Typically, the photoconductor substrate is uniformly coated with a thin layer of a metal, preferably aluminum, which functions as an electrical ground plane. In a further preferred embodiment, the aluminum is anodized to convert the aluminum surface into a thicker aluminum oxide surface. Alternatively, the ground plane member may comprise a metallic plate formed, for example, from aluminum or nickel, a metallic drum or foil or a plastic film on which aluminum, tin oxide, indium oxide or the like is vacuum evaporated. Typically, the photoconductor substrate will have a thickness adequate to provide the required mechanical stability. For example, flexible web substrates generally have a thickness of from about 0.01 to about 0.1 microns, while drum substrates generally have a thickness of from about 0.75 mm to about 1 mm.

Typically, the charge generation layer will be applied to a photoconductor substrate, with a charge transport layer formed on the charge generation layer. In accordance with techniques known in the art, one or more barrier layers may be provided between the substrate and the charge generation layer. Typically, such barrier layers have a thickness of from about 0.05 to about 20, preferably from about 2 to about 6 microns. It is equally within the scope of the present invention that the charge transport layer is first formed on the photoconductor substrate, followed by formation of the charge generation layer on the charge transport layer.

Generally, the charge generation layer will have a thickness of from about 0.05 to about 5, preferably from about 0.1 to about 1, microns, and the charge transport layer will have a thickness of from about 10 to about 50, preferably from about 20 to about 30, microns. The charge generation composition may be formed by dispersing or dissolving the charge generation molecule, polymeric hindered phenol, binder and solvent to form a dispersion or solution. The charge generation layer is formed by coating the charge generation composition on the respective underlying layer and drying the coating. Similarly, the charge transport layer may be formed by dispersing or dissolving the charge transport compound in a polymeric binder and solvent, to form a charge transport composition; coating the charge transport composition on the respective underlying layer and drying the coating. Suitable coating techniques include dip-coating, spray-coating, blade-coating and roller-coating.

As set forth above, the charge generation layer comprises a charge generation compound, a hindered polymeric phenol selected from butylated reaction products of p-cresol and dicyclopentadiene and an additional binder other than the hindered polymeric phenol. The additional binder of the charge generation layer may be any binder known in the art for use in charge generation layers. The charge generation layer generally comprises total binder in an amount of at least about 10%, preferably at least about 20%, and up to about 90%, preferably up to about 75%, by weight of the charge generation layer; and total butylated reaction product of p-cresol and dicyclopentadiene in an amount of at least about 1%, preferably from about 1% to about 80%, more preferably from about 20% to about 60%, and even more preferably from about 25% to about 55%, by weight of the charge generation layer. Generally the binder blend comprises no more than about 90%, by way of total blend, of the polymeric hindered phenols, for levels of polymeric hindered phenols above 90% may affect the stability of the dispersion which forms the charge generation layer. The charge generation layer generally comprises charge generation molecule in an amount of at least about 5%, preferably at least about 10%, more preferably at least about 15%, and up to 60%, preferably up to about 50%, more preferably from about 15% to about 40%, by weight of the charge generation layer.

The polymeric hindered phenol provides the photoconductor with resistance to oxidative degradation as compared with a photoconductor which does not include a polymeric hindered phenol. Additionally, the polymeric hindered phenol, when incorporated into the charge generation layer of a dual layer photoconductor, improves the electrical characteristics of the photoconductor without requiring an increase in the amount of charge generation molecule or charge transport molecule. Photoconductors in accordance with the invention typically exhibit high sensitivity, low dark decay and stable performance over life.

In the examples and throughout the present specification, parts and percentages are by weight unless otherwise indicated.

EXAMPLE 1

Three charge generation compositions in accordance with the invention and two comparative examples in accordance to the prior art were prepared.

Sample 1, a charge generation composition in accordance with the invention, was prepared by milling together in a Netzsch mill titanyl phthalocyanine (54.63 g, Type IV, Syntec), polyvinylbutyral BX-55Z (16.69 g, Seksui) and a butylated reaction product of p-cresol and dicyclopentadiene (Wingstay® L HLS, 9.02 g, Goodyear) with cyclohexanone (353.2 g) and methyl ethyl ketone (68.5 g) for 2 hours. The dispersion was let down by adding additional butylated reaction product of p-cresol and dicyclopentadiene (41.06 g) and methyl ethyl ketone (1791.4 g).

Sample 2, a sample in accordance with the invention, was prepared in a method similar to that of Sample 1 except about 33.38 grams of the polymeric hindered phenol and about 33.38 grams of the polyvinylbutyral were used. Thus, Sample 1 had a polyvinylbutyral to polymeric hindered phenol weight ratio of about 1:3, while Sample 2 had a polyvinylbutyral to polymeric hindered phenol weight ratio of about 1:1.

Sample 3, a sample composition in accordance with the invention, was prepared by mixing titanyl phthalocyanine (Type I, 8.19 g Syntec), polyvinylbutyral BX-55Z (1.82 g), butylated reaction product of p-cresol and dicyclopentadiene (Wingstay® L HLS, 3.64 g) and Potter's Glass Beads (60 mls) with cyclohexanone (25 g), methyl ethyl ketone (165 g) in a paint shaker and shaking for 12 hours. The resulting composition was then diluted with 100 grams of methyl ethyl ketone.

Comparative Example 1w as prepared in the method similar to that of Sample 1, except that no polymeric hindered phenol was added. The composition comprised 66.77 grams of polyvinylbutyral.

Comparative Example 2 was repaired in a manner similar to that of Sample 3, except that 5.46 grams of polyvinylbutyral was used, and no polymeric hindered phenol was added.

EXAMPLE 2

Photoconductor drums were prepared using the sample and comparative example charge generation compositions. The photoconductors all comprised a charge transport layer formed using a charge transport composition comprising polycarbonate (MAKROLON®-5208, Bayer) and 30% 4,4'-bis (N,N'-diphenyl-N,N'-(3-tolyl)) benzidine in a mixture of tetrahydrofuran and 1,4 dioxane (20% solids). The substrate for the photoconductor was an aluminum substrate having a thickness of 5 um of anodizing layer.

Photoconductors were prepared by applying the charge generation compositions to the aluminum substrate by dip-coating. The coated drums were then dried in an oven at about 100° C. for about fifteen minutes, and were then dip-coated with the charge transport composition, and dried at about 120° C. for about 60 minutes. The coat weight was from about 16 to about 17 mg/in$^2$.

The voltages of photoconductor drums comprising a charge generation layer prepared using Sample 1 or Comparative Example 1 were measured by a parametric tester, in which post-develop time is varied within a range of 25 to 165 ms. The photoconductor voltage at laser energy 0.30 and 0.35 $\mu$J/cm$^2$, is set forth in Tables 1 and 2.

TABLE 1

Negative Photoconductor Voltage is at energy E = 0.3 $\mu$J/cm$^2$.

| MS Post Exposures | 25 | 63 | 110 | 165 |
|---|---|---|---|---|
| Sample 1 | 199 | 133 | 116 | 97 |
| Comparative Example 1 | 289 | 226 | 203 | 202 |

TABLE 2

Negative Photoconductor Voltage at Energy E = 0.35 $\mu$J/cm$^2$

| MS Post Exposure | 25 | 63 | 110 | 165 |
|---|---|---|---|---|
| Sample 1 | 194 | 124 | 104 | 88 |
| Comparative Example 1 | 280 | 216 | 194 | 187 |

In a preferred embodiment, the photoconductor exhibits a voltage of no greater than about 200 volts 25 milliseconds after exposure to a laser energy of about 0.30 $\mu$J/cm$^2$, and a voltage of no greater than about 100 volts 165 milliseconds after exposure to laser energy of 0.30 $\mu$J/cm$^2$.

Generally the addition of the polymeric hindered phenol to the charge generation layer reduces the photoconductor voltage by from about 50 to about 200 volts as compared to a photoconductor which does not comprise a polymeric hindered phenol in the charge generation layer.

EXAMPLE 3

Initial electrical characteristics were measured with photoconductors comprising a charge generation layer prepared using Sample 3 or Comparative Example 2. The photoconductors of this example were subject to sensitivity measurements using a sensitometer fitted with electrostatic probes to measure the voltage magnitude as a function of light energy shining on the photoconductor surface. The sensitometer included a charging source designed to charge the photoconductor to about −700 V. The photosensitivity is indicated by the photoconductor's residual voltage from its initial charge of about −700 V versus the amount of light energy, in micro joules/cm$^2$. The results of these measurements are set forth in FIG. 1. As is known in the art, sensitivity is measured as the reciprocal of the energy required to discharge a photoconductor from an initial potential, $V_0$, to an arbitrary potential, typically $V_0/2$. The addition of the polymeric hindered phenol did not adversely effect sensitivity.

Figure 2:
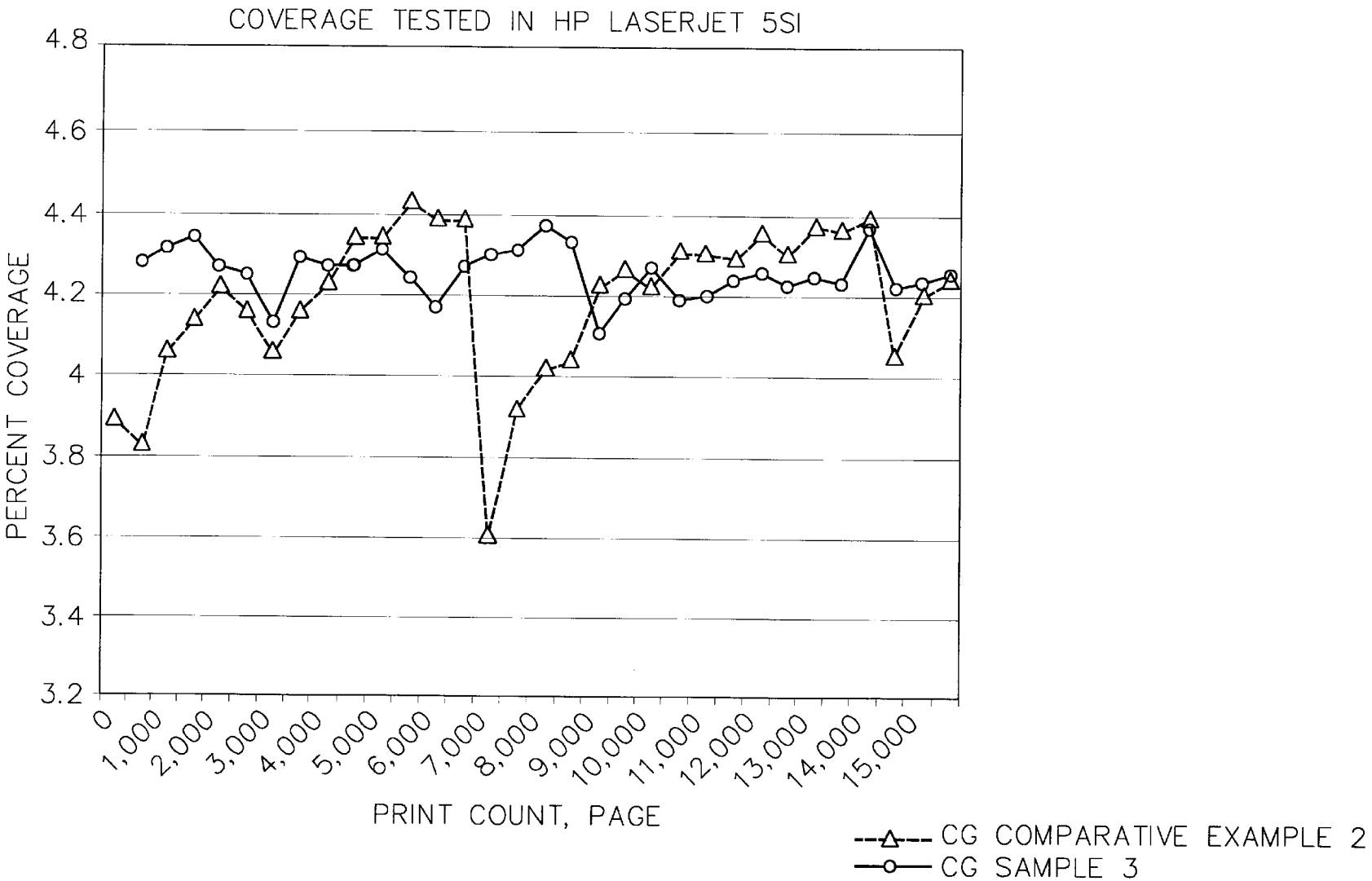
FIG. 2 is a graphical representation of toner yield testing results.

The photoconductor drums were then tested in an HP LaserJet 5SI for coverage, results of which are set forth in FIG. 2. A photoconductor drum having a binder comprising 100%, by weight, polyvinylbutyral BX-55Z (Seksui) and a photoconductor drum having a binder comprising 75%, by weight, butylated reaction product of p-cresol and dicyclopentadiene (Wingstay® L Goodyear) and 25%, by weight, polyvinylbutyral BX-55Z (Seksui) were compared in a toner yield test. A text page was run in a continuous mode at a 5% coverage, with a known amount of toner loaded in the cartridge. The number of pages printed with that known amount of toner is defined as toner yield. Preferably coverage is stable of the cartridge life.

The fluctuation exhibited by the photoconductor drum having a charge generation layer comprising a polymeric hindered phenol was reduced relative to the comparative prior art photoconductor drum having a charge generation layer comprising 100%, by weight, polyvinylbutyral. Thus, the polymeric hindered phenol stabilizes toner yield. While not being bound by theory, it is believed the improved toner yield stability may result from improved stability of the electrical characteristics of photoconductor drums comprising a charge generation layer comprising the polymeric hindered phenol The addition of the polymeric hindered phenol through the charge generating layer improved both initial characteristics in the performance over the life of the printer.

EXAMPLE 4

Photoconductor drums having charge generation layers prepared using Sample 1 or 2 or Comparative Example 1 were tested for cycling fatigue. The charge transport layer had a coat weight of from about 16 to about 17 mg/in$^2$.

Cycling fatigue results set forth in Table 3 below indicate that cycling fatigue can be effectively mitigated by including polymeric hindered phenols selected from the group consisting of butylated reaction products of p-cresol and dicyclopentadiene into the charge generation layer. Measurements for voltage versus energy curves are carried out in a parametric tester by repeated charge and erase, and the comparison of 0K and 1K data at E=0.3 $\mu$J/cm$^2$, together with dark decay changes along with a voltage versus energy curve at 0k were prepared. "0K" data were collected without any pre-cycle during the first charge-erase cycle on a drum, while "1K" data were collected after 1000 cycles.

Dark decay is measured by charging a photoconductor to 850 volts and monitoring charge decay. Dark decay is the charge between the initial charge and the charge after 1 second, and is given in volts/second.

TABLE 3

CYCLING FATIGUE PROPERTIES

| CG Composition | Initial Voltage (volts) | Voltage, 1 k cycle (volts) | Voltage Change after 1 k cycles (volts) | Initial Dark Decay (v/sec) | Dark Decay, 1 k cycles (v/sec) | Dark Decay Change after 1 k cycles (v/sec) |
|---|---|---|---|---|---|---|
| Comparative Example 1 | 210 | 194 | 16 | 36 | 101 | 65 |
| Sample 2 | 149 | 157 | 8 | 23 | 40 | 17 |
| Sample 1 | 103 | 103 | 0 | 31 | 56 | 25 |

In printing processes with high expose-develop times, such as several hundred milliseconds, high dark decay may result in significant loss of charge, which in turn may result in print defects. Thus, it is desirable that a photoconductor has a low dark decay values. Additionally, generally the lower the increase in dark decay with cycling the more stable the photoconductor, thus it is desirable that a photoconductor exhibit low increases in dark decay after numerous cyclings. In one embodiment a photoconductor in accordance with the present invention has an initial dark decay of less than 30 volts/second, preferably less than 25 volts/second, and a dark decay after 1000 cycles of less than 100 volts/second, preferably less than 75 volts/second.

Figure 3:
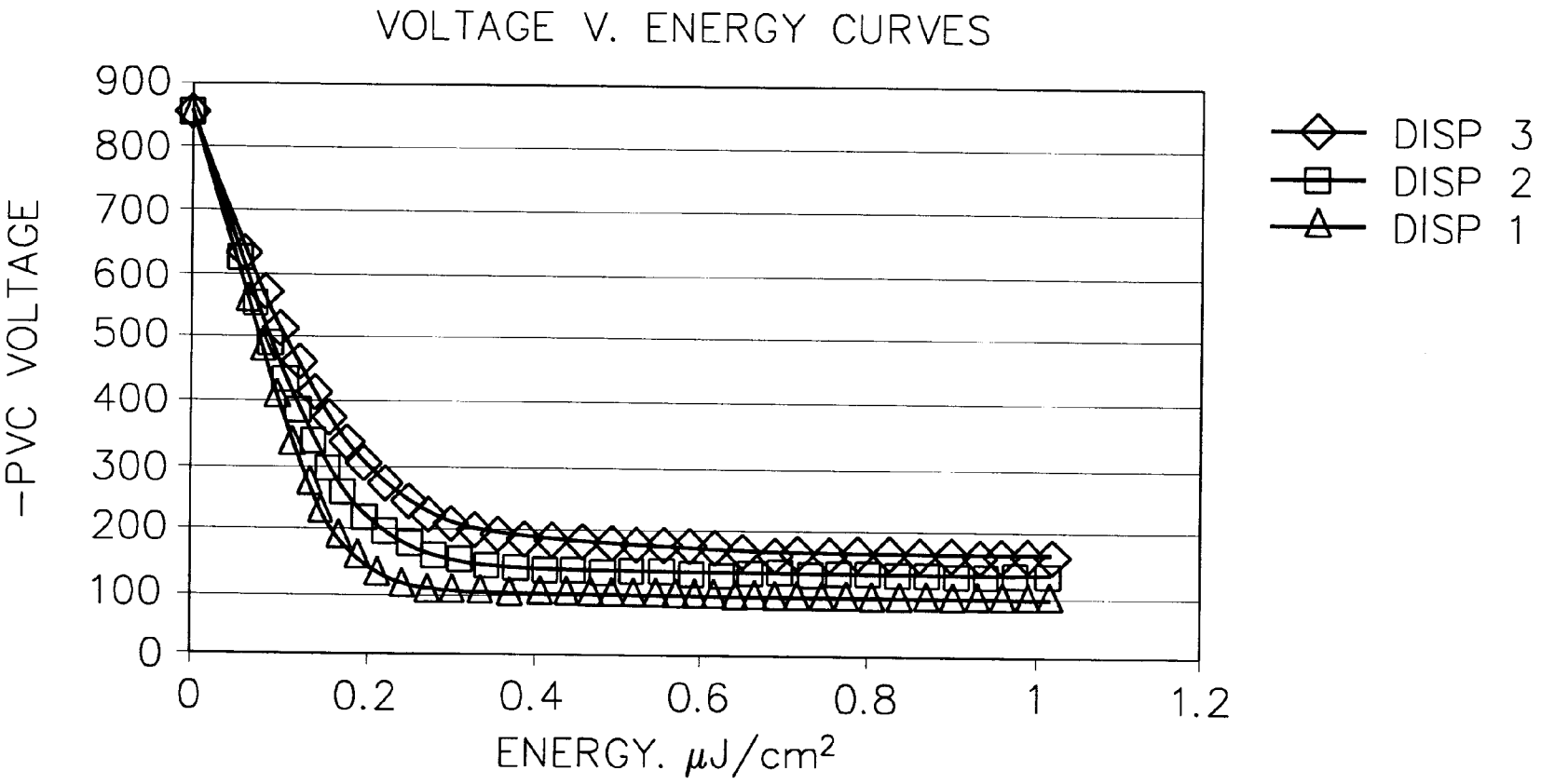
FIG. 3 is a graphical representation of cycling fatigue.

FIG. 3 sets forth voltage versus energy curves. The voltages are initial voltages. "Disp 1" refers to Sample 1, "Disp 2" refers to Sample 2, and "Disp 3" refers to Comparative Example 1. FIG. 3 illustrates that replacing at least a portion of the polyvinylbutyral in a charge generation layer with a polymeric hindered phenol, such as the butylated reaction product of p-cresol and dicyclopentadiene, improves sensitivity and reduces discharge. In a preferred embodiment, no more than about 90% of the polyvinylbutyral in replaced with a polymeric hindered phenol.

Additional embodiments and modifications within the scope of the claimed dimensions will be apparent to one of ordinary skill in the art. Accordingly, the scope of the present invention shall be considered in the terms of the following claims, and is understood not to be limited to the details of the compositions or methods described in the specification.

What is claimed is:

1. A photoconductor comprising a substrate and a charge generation layer comprising a charge generation molecule and a first binder selected from the group consisting of butylated reaction products of p-cresol and dicyclopentadiene.

2. A photoconductor according to claim 1, wherein the charge generation layer further comprises a second binder.

3. A photoconductor according to claim 2, wherein the weight ratio of first binder to second binder is from about 9:1 to about 1:9.

4. A photoconductor according to claim 2, wherein the second binder is a polyvinylbutyral binder.

5. A photoconductor according to claim 1, wherein the charge generation molecule is selected from the group consisting of phthalocyanines, perylene pigments, azo dyes and mixtures thereof.

6. A photoconductor according to claim 1, wherein the weight ratio of total charge generation molecule to total binder is from about 5:1 to about 1:2.

7. A photoconductor according to claim 1, wherein the charge generation layer comprises from about 20% to about 60%, by weight, total charge generation molecule and from about 80% to about 40%, by weight, total binder.

8. A photoconductor according to claim 1, wherein the photoconductor further comprises a charge transport layer.

9. A photoconductor according to claim 8, wherein the charge transport layer comprises a charge transport molecule selected from the group consisting of triarylamines, benzidines, hydrazones and mixtures thereof.

10. A method of improving an electrical characteristic of a photoconductor, comprising the step of forming a photoconductor comprising a substrate and a charge generation layer comprising a binder blend;

wherein the binder blend comprises a first binder selected from the group consisting of butylated reaction products of p-cresol and dicyclopentadiene and a second binder.

11. A photoconductor according to claim 10, wherein the weight ratio of first binder to second binder is from about 9:1 to about 1:9.

12. A method according to claim 11, wherein the weight ratio first binder to second binder is from about 3:1 to about 1:5.

13. A method according to claim 10, wherein the binder blend comprises, by weight of total binder blend, no more than about 90% of the first binder.

14. A method according to claim 13, wherein the binder blend comprises, by weight of total binder blend, no more than about 75% of the first binder.

15. A method according to claim 10, wherein the second binder is a polyvinylbutyral binder.

16. A method according to claim 10, wherein the charge generation molecule is selected from the group consisting of organic charge generation molecules.

17. A method according to claim 10, wherein the photoconductor further comprises a charge transport layer.

18. A method according to claim 17, wherein the charge transport layer comprises a charge transport molecule selected from the group consisting of triarylamines, benzidines, hydrazones and mixtures thereof.

19. A method of improving fatigue properties of a photoconductor comprising an organic photoreceptor, the method comprising the step of forming a photoconductor comprising a substrate and a charge generation layer comprising an organic charge generation molecule and a polymeric hindered phenol selected from the group consisting of butylated reaction products of p-cresol and dicyclopentadiene.

20. A method according to claim 19, wherein the charge generation layer further comprises a binder other than the polymeric hindered phenol.

21. A method according to claim 19, wherein the binder comprises, by weight of total binder, from about 25% to about 75% polymeric hindered phenol.

22. A method according to claim 19, wherein the photoconductor further comprises a charge transport layer comprising a charge transport molecule selected from the group consisting of triarylamines, benzidines, hydrazones and mixtures thereof.

23. A method according to claim 19, wherein the charge generation layer comprises from about 45% to about 60%, by weight, charge generation molecule and from about 40% to about 55%, by weight, total binder.

24. A charge generation composition comprising charge generation molecule, solvent and binder blend, wherein the binder blend comprises a polymeric hindered phenol selected from the group consisting of butylated reaction products of p-cresol and dicyclopentadiene.

25. A charge generation composition according to claim 24, wherein the binder blend comprises, by weight of total binder blend, no more than about 90%, polymeric hindered phenol.

26. A charge generation composition according to claim 24, wherein the binder blend comprises a polyvinylbutyral binder.

27. A charge generation composition according to claim 24, wherein the composition comprises at least about 1%, by weight, total binder, and at least about 2%, by weight, charge generation molecule.

28. A charge generation composition according to claim 26, wherein the weight ratio of polymer hindered phenol to polyvinylbutyral binder is from about 9:1 to about 1:9.

29. A charge generation composition according to claim 28, wherein the weight ratio of polymer hindered phenol to polyvinylbutyral binder is from about 3:1 to about 1:3.

30. A charge generation composition according to claim 24, wherein the charge generation molecule is selected from the group consisting of phthalocyanines, perylene pigments, azo dyes and mixtures thereof.

31. A charge generation composition according to claim 24, wherein the solvent is selected from the group consisting of cyclohexaone, methyl ethyl ketone and mixtures thereof.

32. A photoconductor comprising a charge generation layer comprising a first binder which is a polymeric hindered phenol selected from the group consisting of butylated reaction products of p-cresol and dicyclopentadiene, wherein the molecular weight of the polymeric hindered phenol is from about 460 to about 4600.

33. A photoconductor according to claim 32, wherein the charge generation layer further comprises a second binder other than the polymeric hindered phenol.

34. A photoconductor according to claim 33, wherein the weight ratio of polymeric hindered phenol to second binder is from about 1:1 to about 3:1.

35. A photoconductor according to claim 32, wherein the charge generation layer further comprises a charge generation molecule in a weight ratio of charge generation molecule to total binder from about 1:1 to about 2:1.

36. A photoconductor according to claim 32, wherein the charge generation layer comprises from about 20% to about 60%, by weight of the charge generation layer, butylated reaction products of p-cresol and dicyclopentadiene.

37. A photoconductor according to claim 32, wherein the charge generation layer comprises from about 25% to about 55%, by weight of the charge generation layer, butylated reaction product of p-cresol and dicyclopentadiene; and from about 15% to about 40%, by weight of the charge generation layer, charge generation molecule.

* * * * *